US008737892B2

(12) United States Patent
Oba et al.

(10) Patent No.: US 8,737,892 B2
(45) Date of Patent: May 27, 2014

(54) IMAGE FORMING APPARATUS

(75) Inventors: Katsuhiko Oba, Odawara (JP); Atsushi Kawarago, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 13/209,672

(22) Filed: Aug. 15, 2011

(65) Prior Publication Data

US 2012/0057901 A1 Mar. 8, 2012

(30) Foreign Application Priority Data

Sep. 8, 2010 (JP) ..... 2010-200917

(51) Int. Cl.
*G03G 15/20* (2006.01)

(52) U.S. Cl.
USPC ..... 399/320; 399/33; 399/67; 399/122

(58) Field of Classification Search
USPC ..... 399/33, 67, 122, 320
See application file for complete search history.

(56) References Cited

U.S. PATENT DOCUMENTS 7,974,553 B2 7/2011 Matsuo et al.
2010/0028044 A1 * 2/2010 Matsuo et al. ..... 399/122

FOREIGN PATENT DOCUMENTS

JP 7-210023 A 8/1995
JP 2005-77615 A 3/2005
JP 2010-032833 2/2010

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

The invention provides an image forming apparatus, having: an apparatus main body; a fixing unit fixing an image onto a recording material at a fixing nip portion, the fixing unit including a pressure-applying portion applying a pressure to the fixing nip portion and a pressure-releasing portion releasing the pressure; an opening/closing member disposed in the apparatus main body; an engaging portion engaging with the pressure-releasing portion of the fixing unit in a state of being mounted to the apparatus main body for moving the pressure-releasing portion, the engaging portion moving in conjunction with an opening/closing action of the opening/closing member; and a phase adjusting portion adjusting a phase of the pressure-releasing portion to a phase of the engaging portion when the opening/closing member is opened, in conjunction with a mounting action of the fixing unit to the apparatus main body.

15 Claims, 8 Drawing Sheets

IMAGE FORMING APPARATUS

BACKGROUND OF THE INVENTION

1. Field of the Invention

The present invention relates to an image forming apparatus.

2. Description of the Related Art

There is known an image forming apparatus having a unit that releases pressure-contact of a fixing member in conjunction with an opening action of an opening/closing cover of the image forming apparatus and allows for the pressure-contact of the fixing member in conjunction with a closing action of the opening/closing cover (see Japanese Patent Application Laid-Open No. 2005-077615). In the case where a recording sheet is jammed at a fixing nip portion, when the opening/closing cover is opened, a pressing state of the fixing nip portion is released. Therefore, there are the advantages that no motor is needed for releasing the pressure to reduce the cost, and that the release of pressure can be performed easily.

There are some image forming apparatuses in the market, in which an apparatus main body is set to have a longer life than a fixing unit. In such apparatus, the fixing unit can be exchanged.

In the above-mentioned apparatus in which the pressing state of the fixing nip portion is released in conjunction with the opening action of the opening/closing cover, if the fixing unit is exchangeable, the following problem occurs. FIGS. 8A to 8E are schematic views illustrating a mounting action of the fixing unit in the image forming apparatus.

In FIGS. 8A to 8E, a coupling 61, as an interlocking member that works in conjunction with the opening/closing cover, is disposed in the main body of the image forming apparatus, and a cam member 62, as a pressure-releasing member, is disposed in a fixing unit T. A fixing nip portion N is pressed (FIG. 8E), or the pressure thereof is released or reduced (FIG. 8A), by rotation of the cam member 62.

The coupling 61 works in conjunction with the opening action of the opening/closing cover (not shown) disposed in the main body of the image forming apparatus, and rotates from a position of FIG. 8E in the clockwise direction in FIG. 8E to a position of FIG. 8A. In conjunction with rotation of the coupling 61, the cam member 62 rotates so as to release or reduce the pressure to the fixing nip portion N. As illustrated in FIG. 8B, in the state where the pressure to the fixing nip portion N is released or reduced, the fixing unit T can be mounted to or detached from the image forming apparatus in the left direction of FIG. 8B.

While a user is detaching the fixing unit T from the image forming apparatus (FIG. 8B) and performing a jam recovery or the like, the user may touch the cam member 62 unintentionally so that the cam member 62 rotates by a rotation angle other than the angle for releasing pressure of the fixing member. If a phase shift between the cam member 62 and the coupling 61 occurs (FIG. 8C), a rib 62*a* of the cam member 62 for rotating the cam member 62 cannot be inserted into the coupling 61 (FIG. 8D). Then, the fixing unit T cannot be mounted to the image forming apparatus.

SUMMARY OF THE INVENTION

The present invention provides an image forming apparatus in which a fixing unit is mountable to or detachable from an apparatus main body, and usability can be improved when the fixing unit is mounted to the apparatus main body.

The present invention provides an image forming apparatus in which the fixing nip portion can be switched between a pressing state and a pressure-releasing state in conjunction with an opening/closing action of an opening/closing member, and the fixing unit can be mounted without caring about a phase of a pressure-releasing portion provided to the fixing unit.

The present invention further provides an image forming apparatus, including: an apparatus main body; a fixing unit fixing an unfixed image, which is formed on a recording material, onto the recording material at a fixing nip portion, the fixing unit being mountable to and detachable from the apparatus main body and including a pressure-applying portion applying a pressure to the fixing nip portion and a pressure-releasing portion releasing the pressure applied to the fixing nip portion by acting on the pressure-applying portion; an opening/closing member disposed in the apparatus main body in an openable/closable manner; an engaging portion disposed in the apparatus main body and engaging with the pressure-releasing portion of the fixing unit in a state of being mounted to the apparatus main body for moving the pressure-releasing portion, the engaging portion moving in conjunction with an opening/closing action of the opening/closing member; and a phase adjusting portion adjusting a phase of the pressure-releasing portion to a phase of the engaging portion when the opening/closing member is opened, in conjunction with a mounting action of the fixing unit to the apparatus main body.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. However, the sizes, materials, shapes, and relative positions of components described in the embodiments should be modified as necessity according to a structure of an apparatus to which the present invention is applied and various other conditions. In other words, the scope of the present invention should not be limited to the following embodiments.

First Embodiment

General Structure of Image Forming Apparatus

With reference to FIGS. 1A to 6B, a first embodiment of the present invention is illustrated. An image forming apparatus 100 according to this embodiment forms an image using an electrophotographic method, such as a copy machine, a printer, or a facsimile machine.

Figure 2:
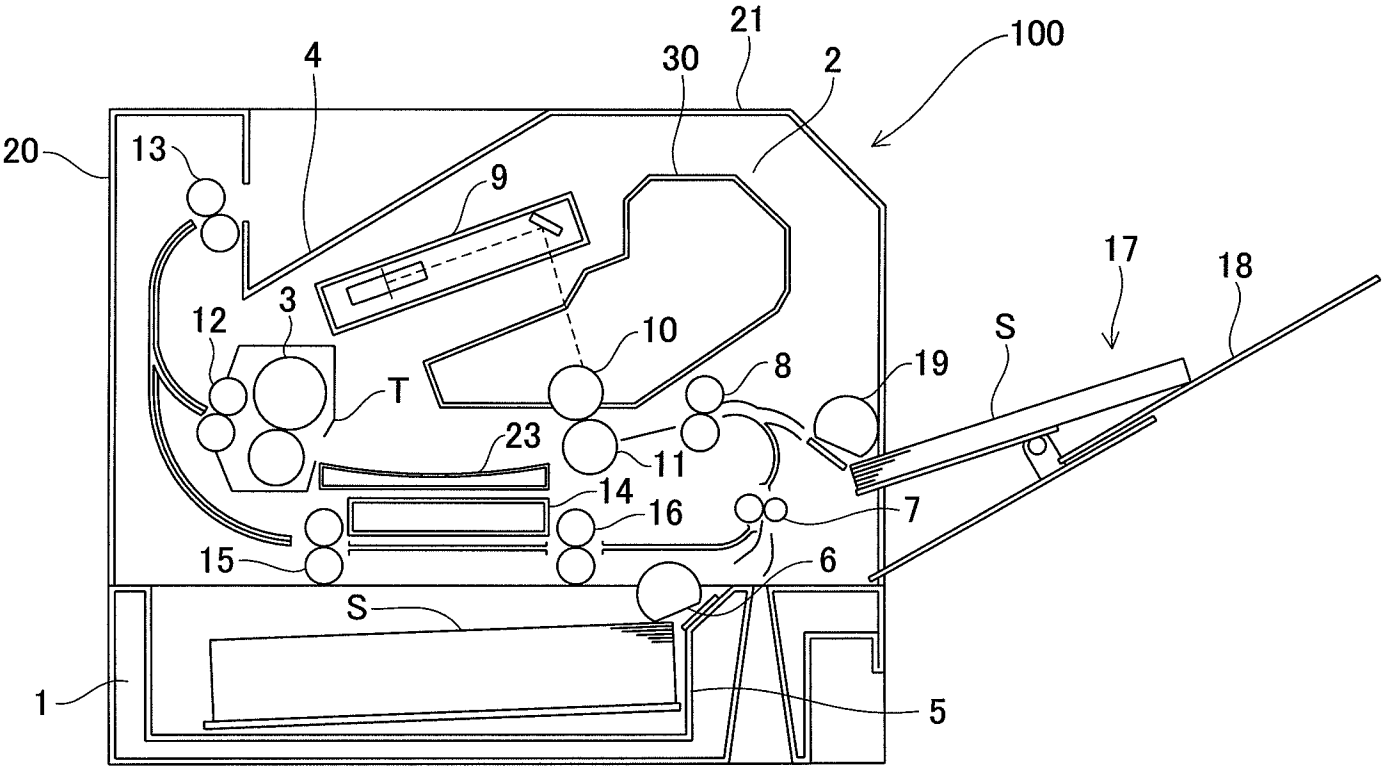
FIG. 2 is a schematic view illustrating a general structure of an image forming apparatus according to the first embodiment.

With reference to FIG. 2, a schematic structure of the image forming apparatus 100 is illustrated along a flow of a recording material S. FIG. 2 is a schematic cross sectional view illustrating the general structure of the image forming apparatus according to the first embodiment.

The image forming apparatus 100 conveys the recording material (recording sheet) S to an image forming unit (image forming portion) 2 by a paper feed and convey unit (paper feed and convey portion) 1, and transfers a toner image (developer image) onto the recording material S. The recording material S is conveyed to a fixing portion 3 to fix the toner, and then the recording material S is delivered to a delivering portion 4.

More specifically, a cassette 5 for storing the stacked recording materials S is mounted to a lower part of the image forming apparatus. The recording materials S stacked and stored in the cassette 5 of the paper feed and convey unit 1 are sent out sequentially from the uppermost recording material S by a feed roller 6 rotating in the counterclockwise direction of FIG. 2, which is further sent to the image forming unit 2 by conveyor roller pairs 7 and 8.

A laser scanner 9 irradiates a photosensitive member 10 rotating in the clockwise direction of FIG. 2 with a laser beam corresponding to image information, and an electrostatic latent image is formed on the photosensitive member 10. The electrostatic latent image is developed by toner in a developing portion in a process cartridge 30. The toner image formed on the photosensitive member 10 is transferred to the recording material S as an unfixed image by a transferring roller 11. The recording material S bearing the unfixed image is sent to the fixing portion 3 and is subjected to a fixing process by a fixing unit T in the fixing portion 3. The recording material S, after the fixing process is finished, is conveyed by a conveyor roller pair 12 and a delivery conveyor roller pair 13, and is delivered to the delivering portion 4 in the upper part of the image forming apparatus.

In FIG. 2, an electrical component 14 has a power-supply portion of the image forming apparatus 100 and a control board for controlling the image forming apparatus 100. In FIG. 2, a sheet conveyor member 23 forms a sheet-transport path between the transferring roller 11 as a transferring portion and the fixing portion 3.

When double-sided recording of the recording material S is performed, the recording material S having passed through the fixing portion 3 to have an image recorded on the front side thereof is switch-back conveyed by reverse drive of the delivery conveyor roller pair 13. The recording material S is again conveyed to the image forming unit 2 by conveyor roller pairs 15 and 16, and an image is recorded on the back side of the recording material S. Then, the recording material S is delivered.

When a manual feeding portion 17 is used for feeding, a manual feed tray 18 is opened, and the recording materials S are stacked on the manual feed tray 18. The recording materials S stacked on the manual feed tray 18 are sent out sequentially from the uppermost recording material S by a manual feed roller 19 rotating in the clockwise direction of FIG. 2, and are further sent to the image forming unit 2 by the conveyor roller pair 8. After being sent to the image forming unit 2, the same image forming process as described above is performed (the description is omitted).

Figure 3:
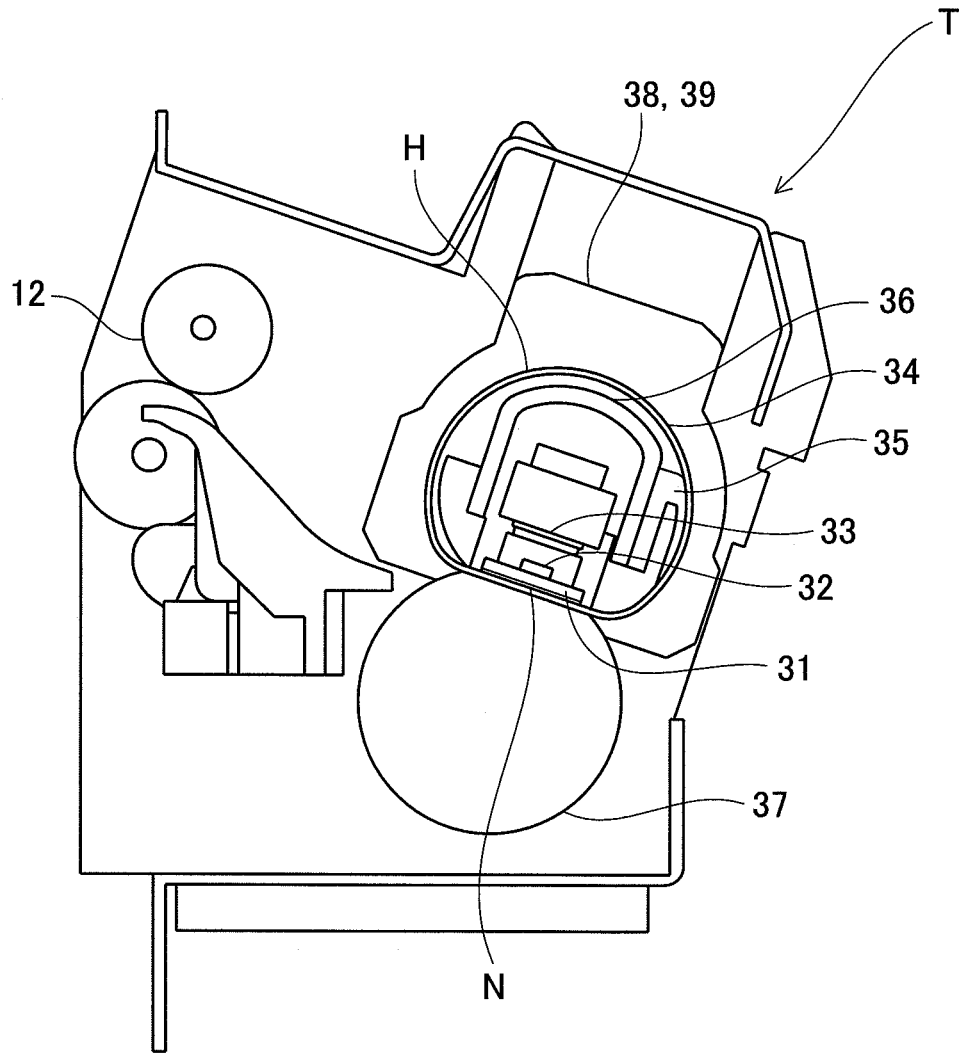
FIG. 3 is a schematic view illustrating the fixing unit according to the first embodiment.

With reference to FIG. 3, the fixing unit T according to the first embodiment is described. FIG. 3 is a schematic cross sectional view of the fixing unit T according to the first embodiment.

In the fixing unit T, a heater 31 is a heating body in which an electric-heat generating element made of a silver alloy and electrodes are printed by screen printing on a ceramic substrate made of alumina or aluminum nitride. The electric-heat generating element is connected to an AC electric control circuit (not shown). A thermistor 32 as a temperature sensing unit is mounted on the heater 31, so as to sense the temperature of the heater 31. In addition, a temperature fuse or a thermal switch 33, as a thermal protector, is disposed on the heater 31, and is connected to an AC power supply in series with the electric-heat generating element. A fixing film 34 includes an elastic rubber layer made of silicone rubber, fluororubber, or the like and a fluorocarbon resin, which are formed around a cylinder-like polyimide resin or stainless steel. The fixing film 34 may be one without the elastic rubber layer. In this fixing film 34, there are incorporated a film guide 35 made of heat-resistant resin such as PPS, PEEK, or liquid crystal polymer and supporting the heater 31, the heater 31, and a reinforcing plate 36 so as to constitute a heating unit H. A pressure roller 37 is a pressing member including an elastic layer made of silicone rubber, fluororubber, or the like formed around a shaft made of aluminum, iron, or the like. A traveling locus of the fixing film 34 is regulated by outer surfaces or inner surfaces of flanges 38 and 39 disposed to be opposed to both ends of the fixing film 34 in the longitudinal direction. In this embodiment, the inner surfaces of the flanges 38 and 39 regulate movement of the fixing film 34 in the longitudinal direction and the traveling locus of the fixing film 34 at both ends. The heating unit H and the pressure roller 37 form a fixing nip portion N as a press-contacting nip portion by being pressed by a pressure-applying mechanism to be described later. When the recording material S passes through this fixing nip portion N, the unfixed image on the recording material S is fixed.

Figure 4B:
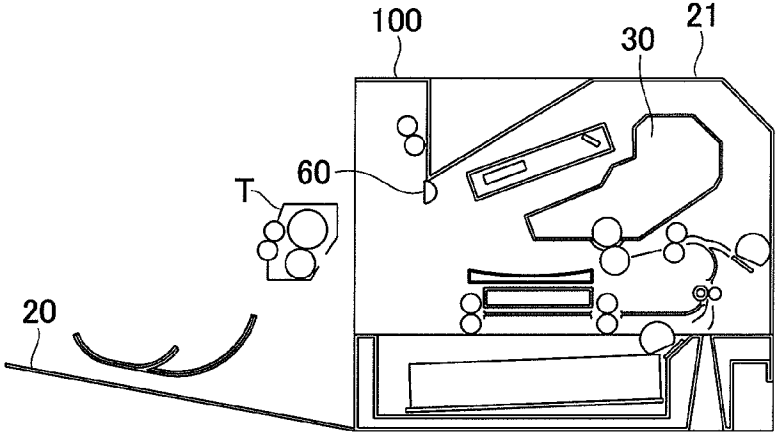
FIGS. 4A, 4B and 4C are schematic views illustrating mounting and detaching of the fixing unit and a process cartridge.
Figure 4A:
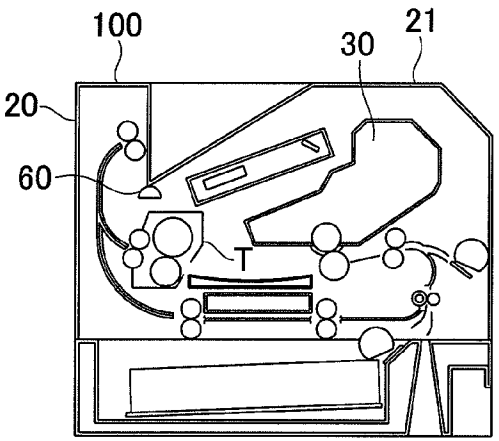
Figure 4C:
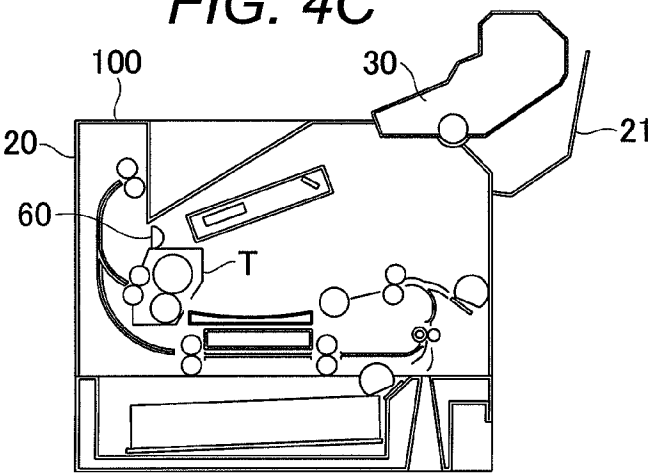

With reference to FIGS. 4A to 4C, mounting and detaching of the fixing unit and the process cartridge are described. FIGS. 4A to 4C are schematic cross sectional views illustrating mounting and detaching of the fixing unit and the process cartridge. FIG. 4A is a schematic view illustrating a state where the fixing unit T and the process cartridge 30 are mounted, FIG. 4B is a schematic view illustrating a state where the fixing unit T is detached, and FIG. 4C is a schematic view illustrating a state where the process cartridge 30 is detached.

Figure 5B:
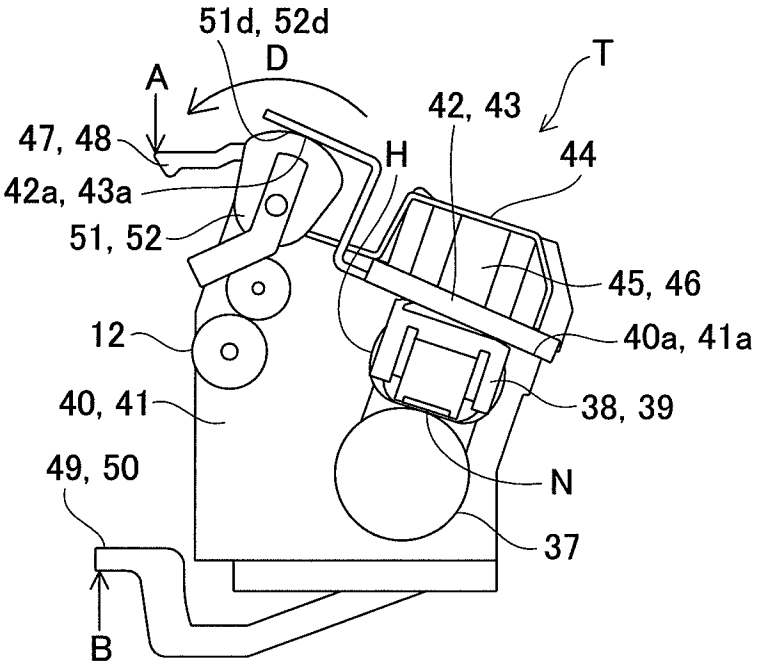
FIGS. 5A and 5B are schematic views illustrating pressing and pressure releasing of a fixing nip portion.
Figure 5A:
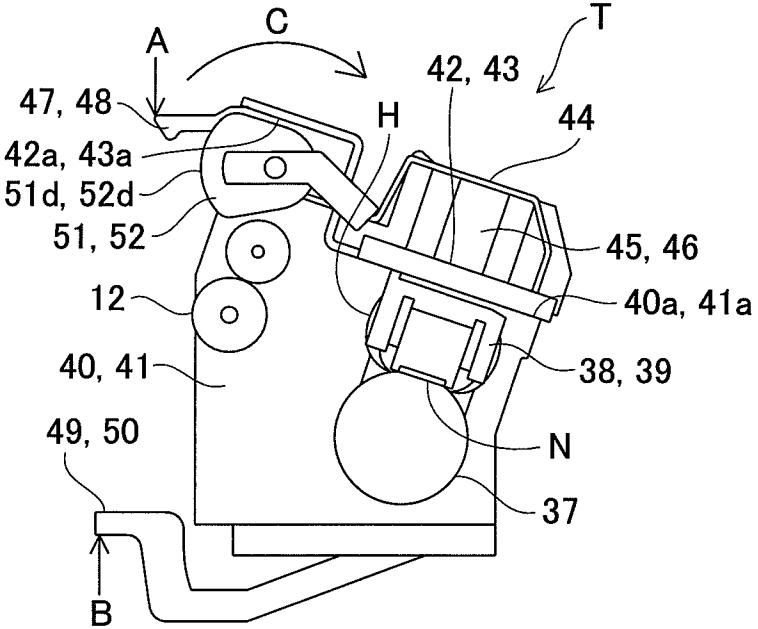

As illustrated in FIG. 4B, when the fixing unit T is detached from the image forming apparatus 100, an opening/closing cover (opening/closing member) 20 is opened so that the inside of the apparatus main body is opened to the outside, and the fixing unit T is detached in the left direction of the figure. When the fixing unit T is mounted to or detached from the image forming apparatus 100, mounting/detaching levers 47 and 48 are moved in a direction of the arrow A, and mounting/detaching levers 49 and 50 are moved in a direction of the arrow B as illustrated in FIGS. 5A and 5B. Thus, a user can easily mount and detach the fixing unit T. In FIGS. 4A to 4C, a coupling 60 as an interlocking member (engaging portion) provided to the image forming apparatus 100 works in conjunction with the opening action of the opening/closing cover 20 via an interlocking mechanism (not shown), and rotates in the clockwise direction of the figure from the position of FIG. 4A to the position of FIG. 4B. When the process cartridge 30 is mounted to or detached from the image forming apparatus 100, an opening/closing cover 21 is opened to mount or detach as illustrated in FIG. 4C. The coupling 60 works in conjunction with the opening action of the opening/closing cover 21 via the interlocking mechanism (not shown), and rotates in the clockwise direction of the figure from the position of FIG. 4A to the position of FIG. 4C. In conjunction with the closing actions of the respective opening/closing covers from the states of FIGS. 4B and 4C, the coupling 60 rotates in the counterclockwise direction of the figure to the position of FIG. 4A. In this way, the coupling 60 rotates in conjunction with the opening/closing actions of multiple opening/closing covers.

With reference to FIGS. 5A and 5B, a pressing structure for forming the fixing nip portion N is described. FIGS. 5A and 5B are schematic cross sectional views illustrating pressing and pressure releasing of the fixing nip portion. FIG. 5A illustrates a state where the fixing nip portion N is pressed, and FIG. 5B illustrates a state where the pressing of the fixing nip portion N is released or reduced.

Both shaft portions of the pressure roller 37 are respectively supported in a rotatable manner to fixing side plates 40 and 41, which are fixed in the fixing unit T. The heating unit H is supported to the fixing side plates 40 and 41 in a movable manner in the fixing direction toward the pressure roller 37 (direction of intimate contact with each other). As illustrated in FIG. 5A, the flanges 38 and 39 of the heating unit H are pressed by pressing plates (pressing members) 42 and 43 so as to form the fixing nip portion N. Pressure springs 45 and 46 are provided between a fixing upper plate 44 and the pressing plates 42 and 43 so as to apply a biasing force to the pressing plates 42 and 43 that press the flanges 38 and 39. In a state where the fixing nip portion N is pressed, one end portions of the pressing plates 42 and 43 are disposed to have a gap with stopper portions 40*a* and 41*a* provided on the fixing side plates 40 and 41. Thus, pressures forces (biasing forces) of the pressure springs 45 and 46 are securely applied to the fixing nip portion N, and hence the fixing nip portion N is formed. In this example, one of the pressure roller 37 and the heating unit H including the flanges 38 and 39 corresponds to a first fixing member while the other corresponds to a second fixing member in the present invention.

The flanges 38 and 39 disposed in the vicinities of both ends of the heating unit H, the pressing plates 42 and 43, the pressure springs 45 and 46, and the mounting/detaching levers 47, 48, 49, and 50 are illustrated only on one end side, while those on the other end side are not illustrated.

As illustrated in FIG. 5B, when cam members 51 and 52 as pressure-releasing members (pressure-releasing portions) rotate, protrusions 51*d* and 52*d* provided on the cam members 51 and 52 lift up respective surfaces 42*a* and 43*a* of the pressing plates 42 and 43. Then, the pressing plates 42 and 43 rotate about the stopper portions 40*a* and 41*a* of the fixing side plates 40 and 41 in the direction against the pressure force of the pressure springs 45 and 46 so as to cut off the pressure force of the pressure springs 45 and 46 to be applied to the flanges 38 and 39. In other words, the cam members 51 and 52 can contact with the pressing plates 42 and 43 so as to generate a force against the pressure force, and change the state of contacting with the pressing plates 42 and 43 so that the force against the pressure force is changed. Thus, the pressure to the fixing nip portion N is released or reduced.

As described above, the pressure-applying mechanism for forming the fixing nip portion N includes members such as the fixing upper plate 44, the pressure springs 45 and 46, and the pressing plates 42 and 43, which are related to application of the pressure. The pressure-applying mechanism is not limited to the above-mentioned structure and may have other structure that applies the pressure for forming the fixing nip portion N.

With reference to FIGS. 4A to 6B, the pressure-releasing action of the fixing nip portion N is described, which is achieved by the coupling 60 as the interlocking member and the cam members 51 and 52 as the pressure-releasing members.

Figure 6B:
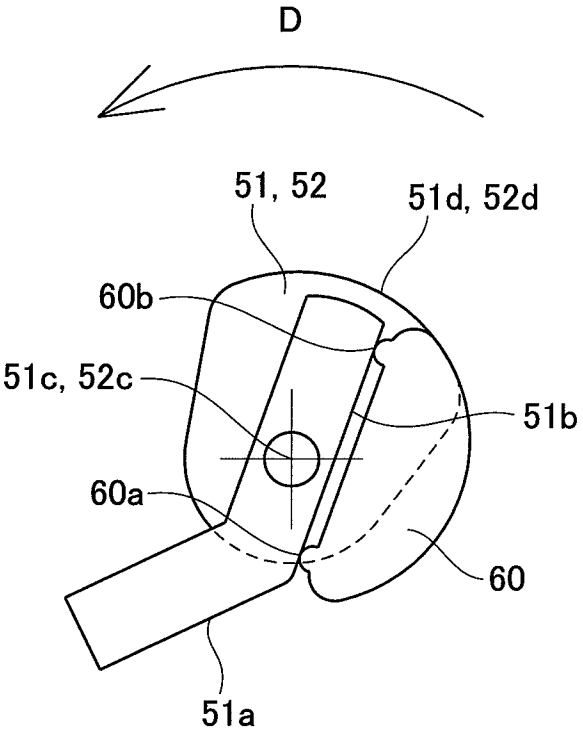
FIGS. 6A and 6B are schematic views illustrating details of a coupling and cam members.
Figure 6A:
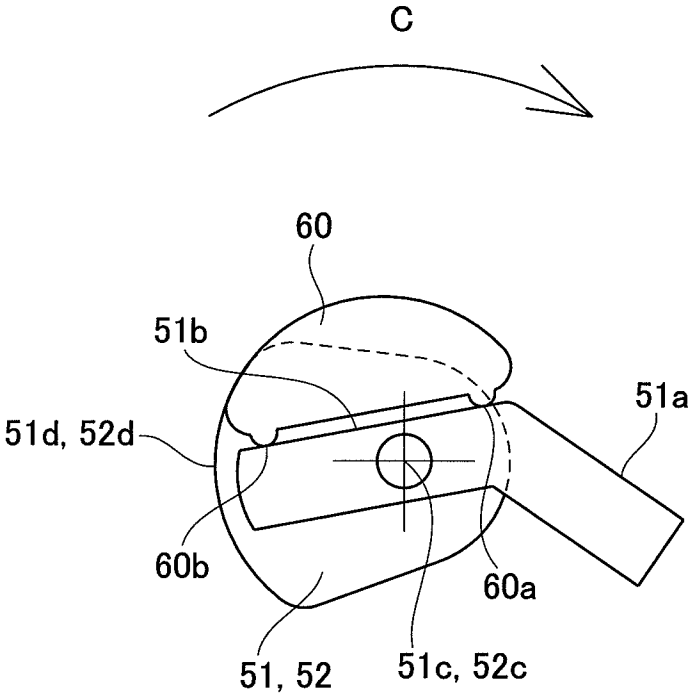

FIGS. 6A and 6B are schematic views illustrating details of the coupling and the cam members, in which the coupling 60 disposed in the image forming apparatus 100 and the cam members 51 and 52 disposed in the fixing unit T are illustrated. FIG. 6A illustrates a state of a pressing position, while FIG. 6B illustrates a state of a releasing position.

The coupling 60 rotates in conjunction with the opening/closing actions of multiple opening/closing covers such as the opening/closing cover 20 enabling to mount and detach the fixing unit T, and the opening/closing cover 21 enabling to mount and detach the process cartridge 30. In conjunction with the opening/closing actions of any one of the above-mentioned opening/closing covers, the coupling 60 rotates in a range from the position of FIG. 6A to the position of FIG. 6B. The coupling 60 contacts with (abuts) a rotating portion 51*b* provided on the cam member 51 in a state where the fixing unit T is fully mounted to the apparatus main body. When the coupling 60 rotates, the rotating portion 51*b* receives a force from a convex portion 60*a* provided on the coupling 60 so as to rotate the cam member 51 about rotation centers 51*c* and 52*c*. In this way, the cam members 51 and 52 are forced to rotate by the coupling 60. When the cam members 51 and 52 rotate, contact states with the pressing plates 42 and 43 are changed in a range from a pressing state in which a maximum pressure force is applied to the pressing unit H (FIG. 5A) to a releasing state in which the pressure force is released or reduced (FIG. 5B). In other words, the coupling 60 can change the contact state between the cam member 51 or 52 and the pressing plate 42 or 43 by applying a force to the cam member 51 or 52.

In conjunction with the opening action of any one of the above-mentioned opening/closing covers, the coupling 60 and the cam members 51 and 52 rotate in a direction of the arrow C from the position of FIG. 6A to the position of FIG. 6B. In this case, because the coupling 60 rotates in the direction of the arrow C, the rotating portion 51*b* receives a force from the convex portion 60*a* provided on the coupling 60 so as to rotate the cam member 51 in the direction of the arrow C about the rotation centers 51*c* and 52*c*. In this way, the cam members 51 and 52 rotate in the direction of the arrow C, and hence the contact state between the cam member 51 or 52 and the pressing plate 42 or 43 is changed from the pressing state (FIG. 5A) to the releasing state (FIG. 5B). Thus, the pressure to the fixing nip portion N is released or reduced.

In conjunction with the closing action of any one of the above-mentioned opening/closing covers, the coupling 60 and the cam members 51 and 52 rotate in a direction of the arrow D from the position of FIG. 6B to the position of FIG. 6A. In this case, because the coupling 60 rotates in the direction of the arrow D, the rotating portion 51*b* receives a force from the convex portion 60*a* provided on the coupling 60 so as to rotate the cam member 51 in the direction of the arrow D about the rotation centers 51*c* and 52*c*. Thus, the cam members 51 and 52 rotate in the direction of the arrow D, and hence the contact state between the cam member 51 or 52 and the pressing plate 42 or 43 is changed from the releasing state (FIG. 5B) to the pressing state (FIG. 5A). Thus, the fixing nip portion N is pressed.

The cam members 51 and 52 are connected via a connecting member (not shown) and provided to both ends of the connecting member, respectively. A guiding portion 51*a* and the rotating portion 51*b* are provided only to the cam member 51 on one end side, and the cam member 51 is provided on the side on which the coupling 60 is disposed.

The opening/closing cover is not limited to the opening/closing cover 20 for mounting or detaching the fixing unit T, or to the opening/closing cover 21 for mounting or detaching the process cartridge 30.

Figure 1A:
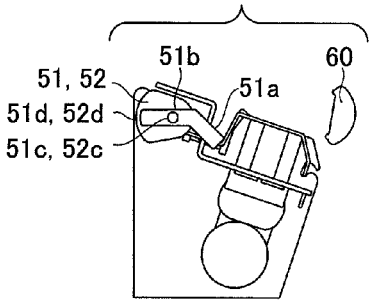
FIGS. 1A, 1B, 1C, 1D, 1E, 1F and 1G are schematic views illustrating a mounting action of a fixing unit according to a first embodiment.
Figure 1B:
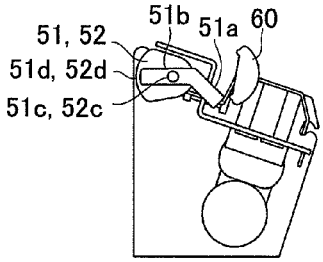
Figure 1C:
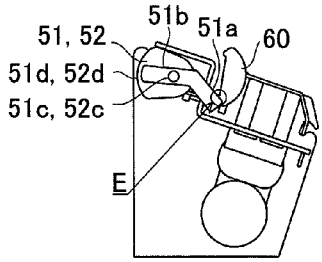
Figure 1D:
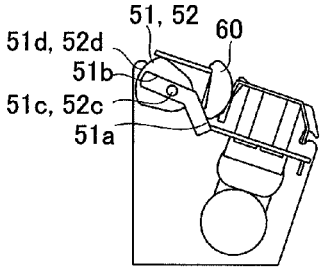
Figure 1E:
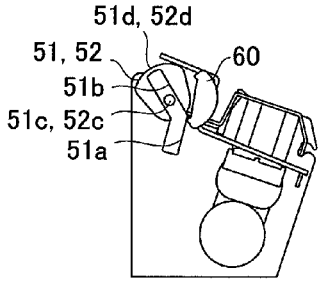
Figure 1F:
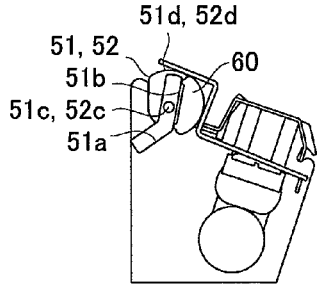
Figure 1G:
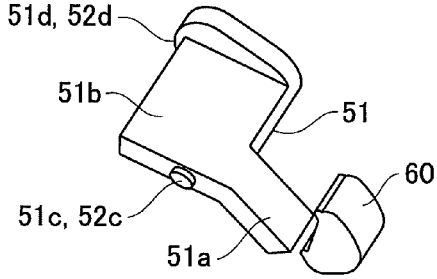

With reference to FIGS. 1A to 1G, a structure for mounting the fixing unit T to the image forming apparatus 100 is described. FIGS. 1A to 1G are schematic cross sectional views illustrating a mounting action of the fixing unit in the first embodiment. FIGS. 1A to 1F sequentially illustrate manners from a state where the fixing unit T is fully detached from the apparatus main body (FIG. 1A) to a state where the fixing unit T is fully mounted to the apparatus main body (the mounting is completed) (FIG. 1F) in order of the proceeding of the mounting. In addition, FIG. 1G is a schematic perspective view of the cam member 51 and the coupling 60.

As described above, the fixing unit T can be mounted to or detached from the image forming apparatus 100 after the opening/closing cover is opened. In other words, when the fixing unit T is detached from the image forming apparatus 100, the coupling 60 and the cam members 51 and 52 are in the pressure-releasing position illustrated in FIG. 1F at which the pressure to the fixing nip portion N is released or reduced.

The direction of detaching the fixing unit T is the left direction in the figure. Therefore, in order to enable the fixing unit T to be detached, in the state of FIG. 1F, the coupling 60 is disposed on the right side in the figure that is opposite to the direction in which the fixing unit T is detached with respect to the rotating portion 51*b* provided on the cam member 51.

It is supposed that after detaching the fixing unit T from the image forming apparatus 100, jam recovery is performed and then the fixing unit T is mounted to the image forming apparatus 100. If the cam members 51 and 52 are in the pressure-releasing positions when the fixing unit T is mounted to the image forming apparatus 100, the fixing unit T is mounted to the image forming apparatus 100 in the state where the cam members 51 and 52 are maintained at the pressure-releasing positions (FIG. 1F).

Next, it is supposed that after the fixing unit T is detached from the image forming apparatus 100, the fixing unit T is mounted to the image forming apparatus 100 in the state where the cam members 51 and 52 are rotated to positions that are different from the pressure-releasing position for a certain reason. For instance, it is conceivable that the user rotates the cam members 51 and 52 by mistake to positions different from the pressure-releasing position while performing the jam recovery. Otherwise, it is conceivable that the cam members 51 and 52 are shifted from the pressure-releasing position due to vibration or shock when the jam recovery is performed. The mounting action of mounting the fixing unit T to the image forming apparatus 100 in such a case is described below with reference to FIGS. 1A to 1G.

FIG. 1A illustrates a state where the cam members 51 and 52 are undesirably rotated to the pressing position (position different from the pressure-releasing position) after the fixing unit T is detached from the image forming apparatus 100.

The contact portion of the cam member 51 with the coupling 60 has the guiding portion 51*a* that is disposed continuously with the rotating portion 51*b* and with an angle different from that of the rotating portion 51*b*. A contact surface (first contact surface) of the rotating portion 51*b* with the coupling 60 and a contact surface (second contact surface) of the guiding portion 51*a* with the coupling 60 form a smoothly curved continuous contact surface. The coupling 60 slides on the second contact surface and moves onto the first contact surface while applying a force to the cam member 51 so that the contact state between the cam member 51 or 52 and the flange 38 or 39 is changed from a state other than the releasing state to the releasing state.

As illustrated in FIGS. 1A to 1C, while the fixing unit T is being inserted into the image forming apparatus 100, the guiding portion 51*a* of the cam member 51 contacts the coupling 60 at a contact portion E (FIG. 1C). In other words, the guiding portion 51*a* contacts the coupling 60 before the fixing unit is completely mounted. A phase of the contact portion E is shifted on the lower side from the rotation center 51*c* of the cam member 51, namely in the height direction. The cam member 51 is pressed by the coupling 60 in the mounting action of the fixing unit T, and hence can rotate in the clockwise direction in the figure. By providing the guiding portion 51*a* that smoothly continues to the rotating portion 51*b*, the rotation angles of the cam members 51 and 52 can be increased.

As illustrated in FIGS. 1D and 1E, when the fixing unit T is further inserted inside the image forming apparatus 100 (as mounting proceeds), the guiding portion 51*a* of the cam member 51 is further pressed to rotate by the coupling 60. In this way, the cam member 51 further rotates toward the pressure-releasing position. In other words, until the fixing unit is completely mounted, the coupling 60 applies a force to the guiding portion 51*a* to change the contact state between the cam member 51 or 52 and the pressing plate 42 or 43 from a state other than the releasing state to the releasing state.

As illustrated in FIG. 1F, when the fixing unit T is completely mounted, the cam members 51 and 52 are rotated to the pressure-releasing position, and the positions of the coupling 60 and the cam members 51 and 52 are the same as the positions before the fixing unit T is detached. In other words, the action of mounting the fixing unit T to the image forming apparatus 100 enables the cam members 51 and 52 to be rotated to the pressure-releasing position by the coupling 60. Thus, the fixing unit T can be mounted to the image forming apparatus 100. In addition, when the fixing unit T is completely mounted, the pressure to the fixing nip portion N can be released or reduced. In this way, according to this embodiment, the cam member 51 includes the phase adjusting portion 51*a* that adjusts phases of the pressure-releasing portions 51 and 52 to the phase of the engaging portion 60 when the opening/closing member is opened, in conjunction with the mounting action of mounting the fixing unit T to the apparatus main body.

The mounting action from the state where the cam members 51 and 52 are in the pressing position is described with reference to FIGS. 1A to 1G, but the mounting action may be from a state where the cam members 51 and 52 are in the range from the pressing position to the pressure-releasing position as illustrated in FIGS. 1D and 1E. Even if the cam members 51 and 52 are in such positions, the cam members 51 and 52 are rotated to the pressure-releasing position as illustrated in FIG. 1F when the fixing unit T is completely mounted, and hence the pressure to the fixing nip portion N can be released or reduced. In other words, even if the cam members 51 and 52 are in any positions within the range from the pressure-releasing position to the pressing position, the cam members 51 and 52 are rotated by the coupling 60 to the pressure-releasing position with the mounting action of the fixing unit T. Therefore, even if the cam members 51 and 52 are in any positions, the fixing unit T can be mounted to the image forming apparatus 100. In addition, when the fixing unit T is completely mounted, the pressure to the fixing nip portion N can be released or reduced.

This embodiment is described by way of the cam member as the pressure-releasing member and the coupling as the interlocking member, but those are not limited thereto. For instance, it is possible to use other members such as a link member that works in conjunction with the cam member, or a slide member, as long as the other members can press the fixing nip portion and can release or reduce the pressure.

As described above, when the fixing unit is detached from the image forming apparatus, even if the cam member rotates, the cam member can be rotated to the pressure-releasing position by the coupling with the action of mounting the fixing unit to the image forming apparatus. In other words, when the fixing unit is mounted to the image forming apparatus, the user is not required to adjust the cam member in advance to a predetermined position. Thus, usability can be improved.

Second Embodiment

With reference to FIGS. 7A to 7D, in an image forming apparatus 100 according to a second embodiment of the present invention, a structure for mounting the fixing unit T to the apparatus main body is described. FIGS. 7A to 7D are schematic cross sectional views illustrating a mounting action of the fixing unit in the second embodiment. FIGS. 7A to 7D sequentially illustrate manners from a state where the fixing unit T is fully detached from the apparatus main body (FIG. 7A) to a state where the fixing unit T is fully mounted to the apparatus main body (the mounting is completed) (FIG. 7D) in order of mounting proceeding.

In the second embodiment, the contact portion of the cam member 51 with the coupling 60 is constituted of only the rotating portion 51*b*. In other words, the guiding portion 51*a* does not extend to have an angle different from that of the rotating portion 51*b* unlike the first embodiment, and hence the rotation angles of the cam members 51 and 52 are small.

Figure 7A:
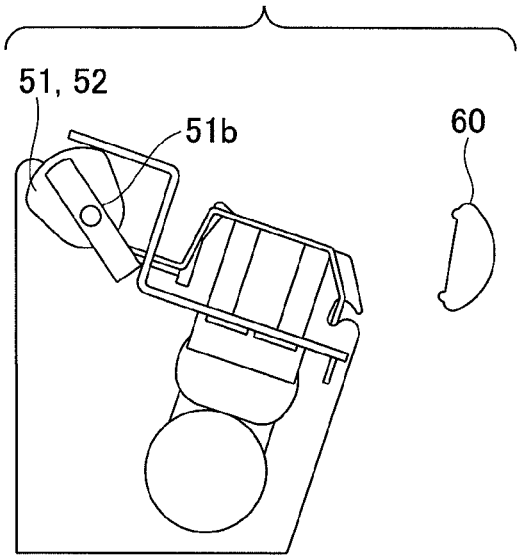
FIGS. 7A, 7B, 7C and 7D are schematic views illustrating a mounting action of a fixing unit according to a second embodiment.
Figure 7B:
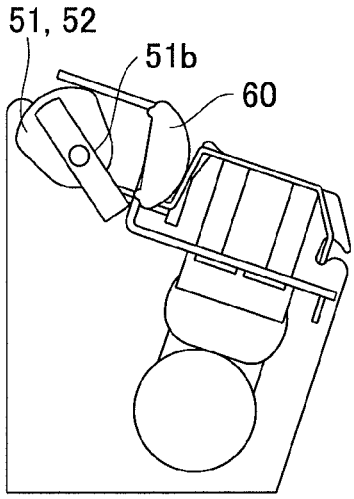
Figure 7C:
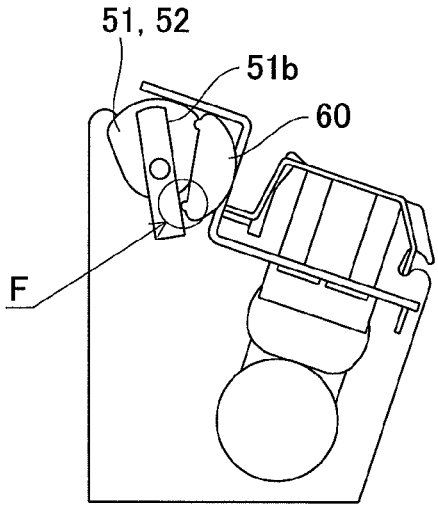
Figure 7D:
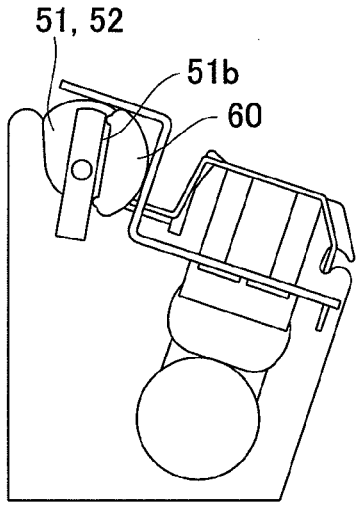
Figure 8A:
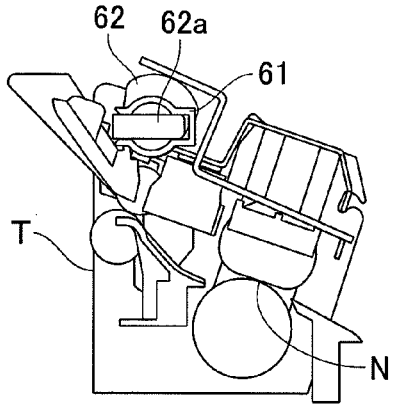
FIGS. 8A, 8B, 8C, 8D and 8E are schematic views illustrating a mounting action of a fixing unit according to a conventional example.
Figure 8B:
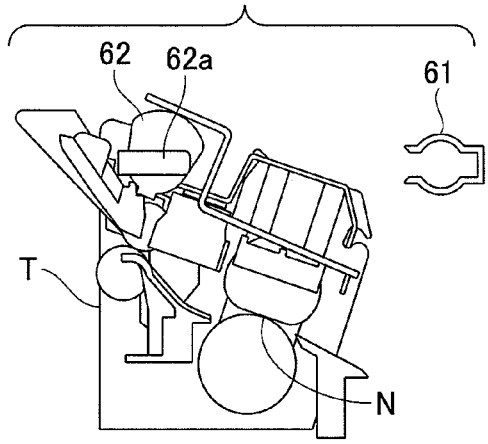
Figure 8C:
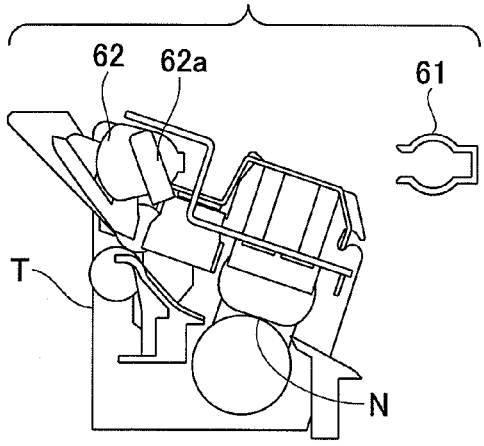
Figure 8D:
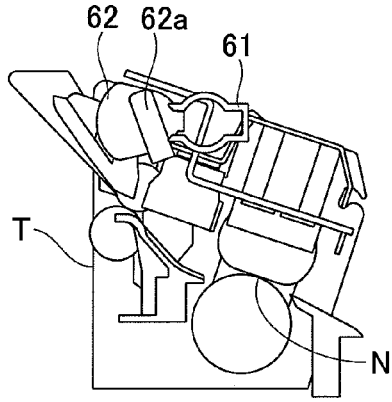
Figure 8E:
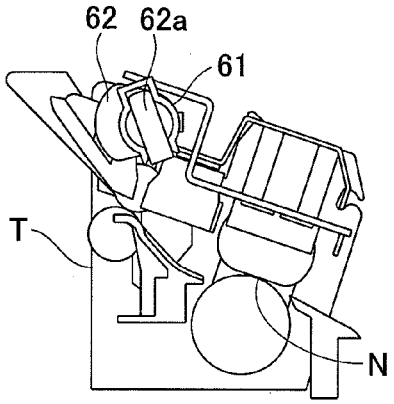

When the fixing unit T is detached from the image forming apparatus 100, the coupling 60 and the cam members 51 and 52 are in the pressure-releasing position illustrated in FIG. 7D at which the pressure to the fixing nip portion N is released or reduced. Next, FIG. 7A illustrates a state where the cam members 51 and 52 are rotated to the pressing position when the fixing unit T is detached from the image forming apparatus 100. If the pressure-releasing amount of the fixing nip portion N is small, the rotation angles of the cam members 51 and 52 can be reduced. Therefore, in the second embodiment, the rotating portion 51*b* is rotated by the coupling 60.

As illustrated in FIGS. 7B and 7C, while the fixing unit T is being inserted into the image forming apparatus 100, the rotating portion 51*b* of the cam member 51 contacts the coupling 60 at a contact portion F (FIG. 7C). As in the first embodiment, a phase of the contact portion F is shifted on the lower side from the rotation center 51*c* of the cam member 51, namely in the height direction. Thus, the cam member 51 is pressed by the coupling 60 in the mounting action of the fixing unit T, and hence can rotate in the clockwise direction in the figure.

As illustrated in FIGS. 7C and 7D, when the fixing unit T is further mounted to the image forming apparatus 100, the rotating portion 51*b* of the cam member 51 is further pressed to rotate by the coupling 60. In this way, the cam member 51 further rotates toward the pressure-releasing position.

As illustrated in FIG. 7D, when the fixing unit T is completely mounted, the cam members 51 and 52 are rotated to the pressure-releasing position, and the positions of the coupling 60 and the cam members 51 and 52 are the same as the positions before the fixing unit T is detached. In other words, the action of mounting the fixing unit T to the image forming apparatus 100 enables the cam members 51 and 52 to be rotated to the pressure-releasing position by the coupling 60. Thus, the fixing unit T can be mounted to the image forming apparatus 100. In addition, when the fixing unit T is completely mounted, the pressure to the fixing nip portion N can be released or reduced.

The mounting action from the state where the cam members 51 and 52 are in the pressing position is described with reference to FIGS. 7A to 7D, but the mounting action may be from a state where the cam members 51 and 52 are in the range from the pressing position to the pressure-releasing position as illustrated in FIG. 7C. Even if the cam members 51 and 52 are in such positions, the cam members 51 and 52 are rotated to the pressure-releasing position as illustrated in FIG. 7D when the fixing unit T is completely mounted, and hence the pressure to the fixing nip portion N can be released or reduced. In other words, even if the cam members 51 and 52 are in any positions within the range from the pressure-releasing position to the pressing position, the cam members 51 and 52 are rotated by the coupling 60 to the pressure-releasing position with the mounting action of the fixing unit T. Therefore, even if the cam members 51 and 52 are in any positions, the fixing unit T can be mounted to the image forming apparatus 100. In addition, when the fixing unit T is completely mounted, the pressure to the fixing nip portion N can be released or reduced.

This embodiment is described by way of the cam member as the pressure-releasing member and the coupling as the interlocking member, but those are not limited thereto. For instance, it is possible to use other members, such as a link member that works in conjunction with the cam member, or a slide member, as long as the other members can press the fixing nip portion and can release or reduce the pressure.

As described above, this embodiment can also provide the same effect as in the first embodiment. In other words, when the fixing unit is mounted to the image forming apparatus, the user is not required to adjust the cam member in advance to a predetermined position. Thus, usability can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-200917, filed Sep. 8, 2010, which is hereby incorporated by reference herein in its entirety.

What is claimed is:

1. An image forming apparatus, comprising:

an apparatus main body;

a fixing unit configured to fix an unfixed image, which is formed on a recording material, onto the recording material at a fixing nip portion, the fixing unit being mountable to and detachable from the apparatus main body and including a pressure applying portion configured to apply a pressure to the fixing nip portion and a pressure releasing portion configured to release the pressure applied to the fixing nip portion by acting on the pressure applying portion;

an opening/closing member disposed in the apparatus main body in an openable/closable manner;

an engaging portion disposed in the apparatus main body and configured to engage with the pressure releasing portion of the fixing unit in a state of being mounted to the apparatus main body for moving the pressure releasing portion, the engaging portion moving in conjunction with an opening/closing action of the opening/closing member; and a phase adjusting portion configured to adjust a phase of the pressure releasing portion to a phase of the engaging portion when the opening/closing member is opened, as the fixing unit moves to a predetermined position in the apparatus main body.

2. An image forming apparatus according to claim 1, wherein:

the phase adjusting portion is disposed in a part of the pressure releasing portion; and as the mounting of the fixing unit to the apparatus main body is proceeding, the phase adjusting portion is moved so as to adjust the phase of the pressure releasing portion to the phase of the engaging portion when the opening/closing member is opened by a reaction force received from the engaging portion.

3. An image forming apparatus according to claim 1, wherein the fixing unit includes a fixing film configured to form the fixing nip portion.

4. An image forming apparatus according to claim 1, wherein the fixing unit includes a heater configured to heat the unfixed image, wherein the heater contacts an inner surface of the fixing film.

5. An image forming apparatus, comprising:

an apparatus main body;

a fixing unit configured to fix an unfixed image, which is formed on a recording material, onto the recording material at a fixing nip portion, the fixing unit being mountable to and detachable from the apparatus main body and including a pressure applying portion configured to apply a pressure to the fixing nip portion and a pressure releasing portion configured to release the pressure applied to the fixing nip portion by acting on the pressure applying portion;

an opening/closing member disposed in the apparatus main body in an openable/closable manner; and an engaging portion disposed in the apparatus main body and configured to engage with the pressure releasing portion of the fixing unit in a state of being mounted to the apparatus main body for moving the pressure releasing portion, the engaging portion moving in conjunction with an opening/closing action of the opening/closing member, wherein the pressure releasing portion includes a phase adjusting portion configured to adjust a phase of the pressure releasing portion to a phase of the engaging portion when the opening/closing member is opened, as the fixing unit moves to a predetermined position in the apparatus main body.

6. An image forming apparatus according to claim 5, wherein the phase adjusting portion is provided at a position of the pressure releasing portion that differs from a position with which the pressure releasing portion contacts the engaging portion when the engaging portion moves.

7. An image forming apparatus according to claim 5, wherein the phase adjusting portion includes a surface having a different angle from an angle of a surface of the pressure releasing portion that the engaging portion contacts when the engaging portion moves.

8. An image forming apparatus according to claim 5, wherein as the mounting of the fixing unit to the apparatus main body is proceeding, the phase adjusting portion is moved so as to adjust the phase of the pressure releasing portion to the phase of the engaging portion when the opening/closing member is opened by a reaction force received from the engaging portion.

9. An image forming apparatus according to claim 5, wherein the fixing unit includes a fixing film configured to form the fixing nip portion.

10. An image forming apparatus according to claim 5, wherein the fixing unit includes a heater configured to heat the unfixed image, wherein the heater contacts an inner surface of the fixing film.

11. An image forming apparatus, comprising:

an apparatus main body;

a fixing unit configured to fix an unfixed image, which is formed on a recording material, onto the recording material at a fixing nip portion, the fixing unit being mountable to and detachable from the apparatus main body and including a pressure applying portion configured to apply a pressure to the fixing nip portion and a cam member configured to release the pressure applied to the fixing nip portion by acting on the pressure applying portion; and a coupling member disposed in the apparatus main body and configured to couple with the cam member for moving the cam member, wherein the cam member includes a phase adjusting portion configured to adjust a phase of the cam member, as the fixing unit moves to a predetermined position in the apparatus main body.

12. An image forming apparatus according to claim 11, wherein the phase adjusting portion is provided at a position of the cam member that differs from a position of the cam member which the coupling member contacts when the coupling member moves.

13. An image forming apparatus according to claim 11, wherein the phase adjusting portion includes a surface having a different angle from an angle of a surface of the cam member that the coupling member contacts when the coupling member moves.

14. An image forming apparatus according to claim 11, wherein the fixing unit includes a fixing film configured to form the fixing nip portion.

15. An image forming apparatus according to claim 14, wherein the fixing unit includes a heater configured to heat the unfixed image, wherein the heater contacts an inner surface of the fixing film.

* * * * *